US007429297B1

(12) United States Patent
Chandler

(10) Patent No.: US 7,429,297 B1
(45) Date of Patent: Sep. 30, 2008

(54) APPLICATOR FOR TEXTURING

(76) Inventor: Dennis J. Chandler, 1242 Lester Ave., South Lake Tahoe, CA (US) 96150

( * ) Notice: Subject to any disclaimer, the term of this patent is extended or adjusted under 35 U.S.C. 154(b) by 250 days.

(21) Appl. No.: 11/097,922

(22) Filed: Mar. 31, 2005

Related U.S. Application Data

(60) Provisional application No. 60/558,738, filed on Mar. 31, 2004.

(51) Int. Cl.
*B64D 1/16* (2006.01)
*B05C 19/00* (2006.01)

(52) U.S. Cl. ..... 118/303; 118/308; 239/219

(58) Field of Classification Search ..... 118/303, 118/308, 258, 260–261, 264; 451/442; 239/219, 239/220, 215; 427/180
See application file for complete search history.

(56) References Cited

U.S. PATENT DOCUMENTS 2,736,996 A * 3/1956 Hoyet ..... 451/442
2,865,325 A 12/1958 Leston et al. ..... 118/300
3,188,295 A 6/1965 Ballast et al. ..... 260/2.5
4,390,284 A * 6/1983 Hyde et al. ..... 366/165.5
5,915,627 A 6/1999 Plasko

* cited by examiner

*Primary Examiner*—Yewebdar T Tadesse
(74) *Attorney, Agent, or Firm*—Lewis and Roca LLP

(57) ABSTRACT

An applicator comprising: a casing defined by two side walls and a cylinder wall, said cylinder wall comprising an opening on one side of said casing; a material container coupled to a side of said casing opposite said opening in a position that allows gravity to direct drywall material in said material container towards the interior of said casing, said container including a flow gate configured to control the flow of said drywall material from said material container to the interior of said casing; an adjustable flick plate coupled to said casing at the bottom of said opening; a brush assembly rotatably coupled to said casing, said brush assembly configured to project said drywall material from said opening; and a handle comprising a trigger that controls said flow gate.

12 Claims, 5 Drawing Sheets

LEFT SIDE

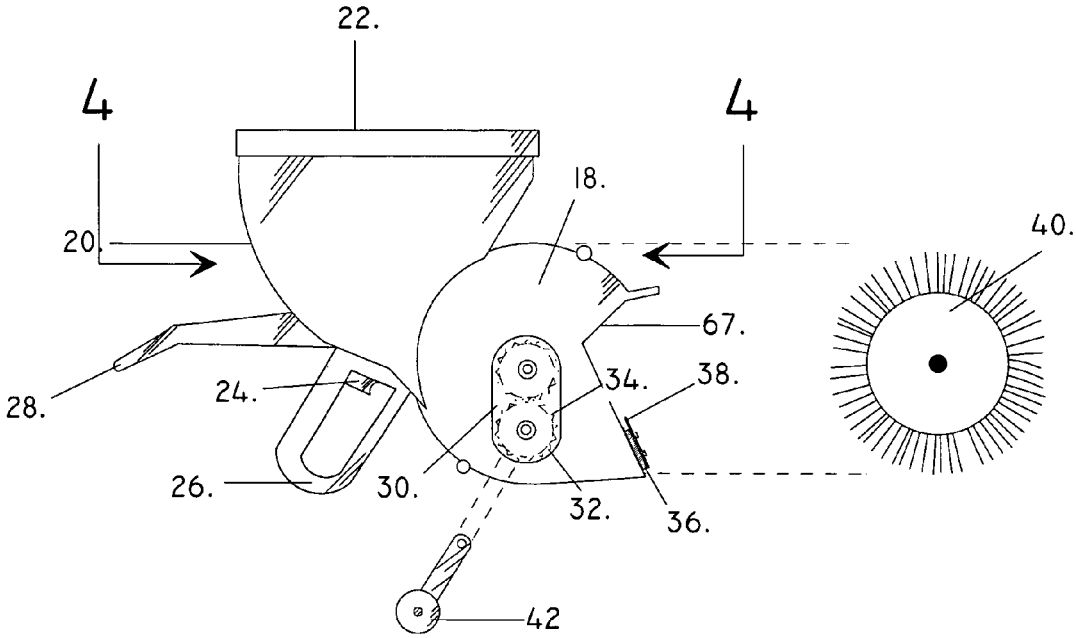
FIG. 1 LEFT SIDE
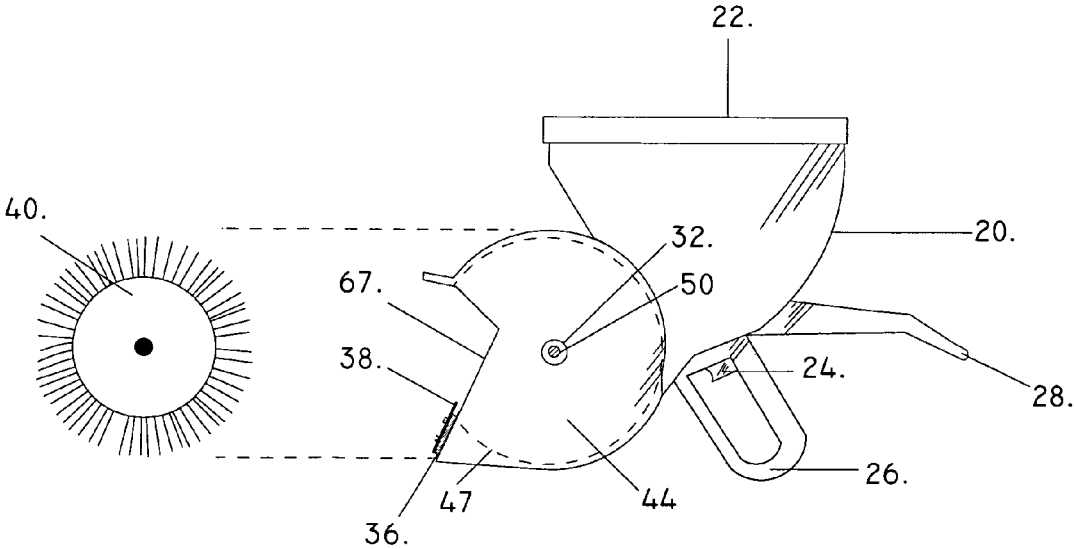
FIG. 2 RIGHT SIDE

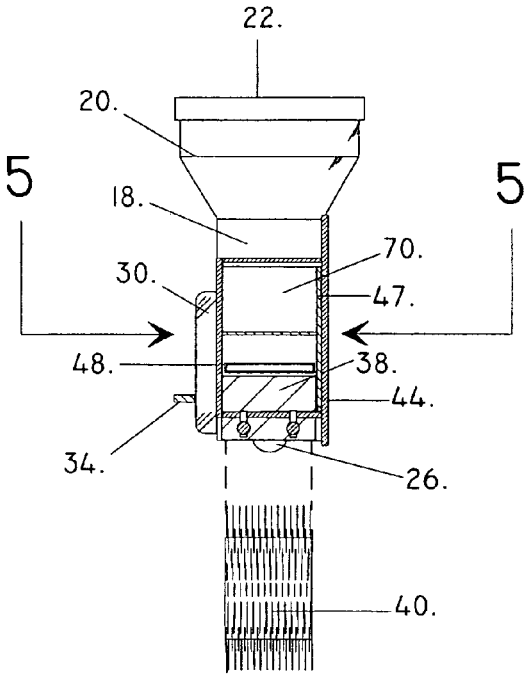
FIG. 3 - FRONT
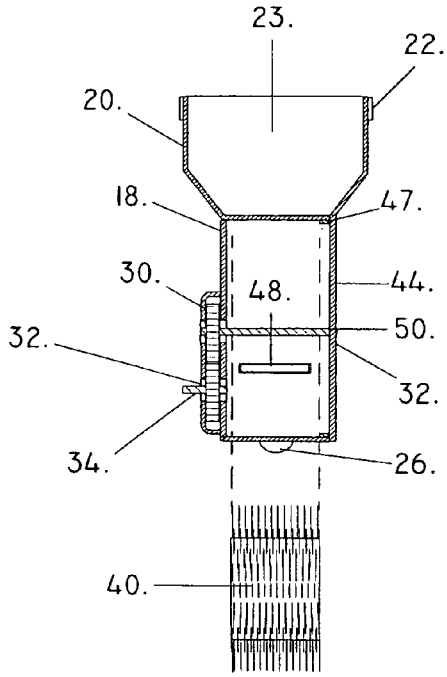
FIG. 5 - SECTION
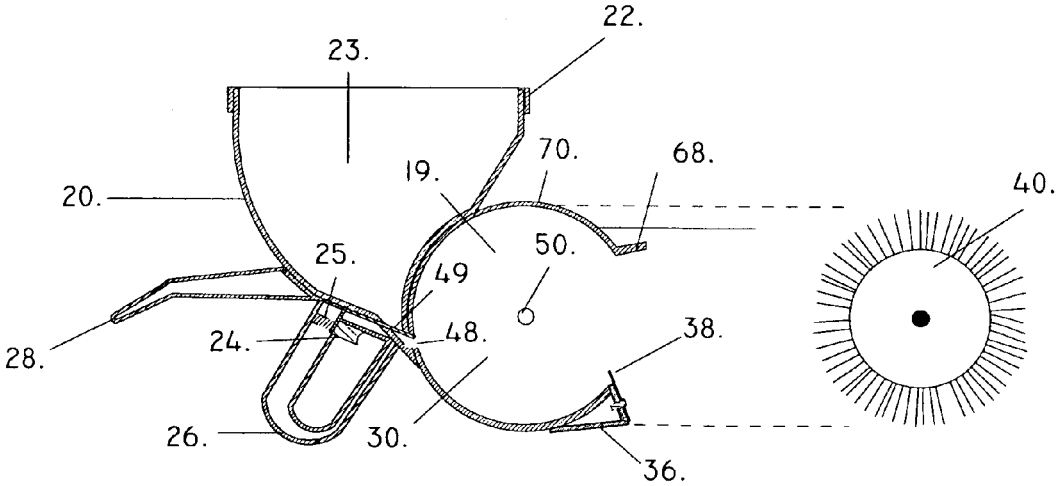
FIG.4 - SECTION

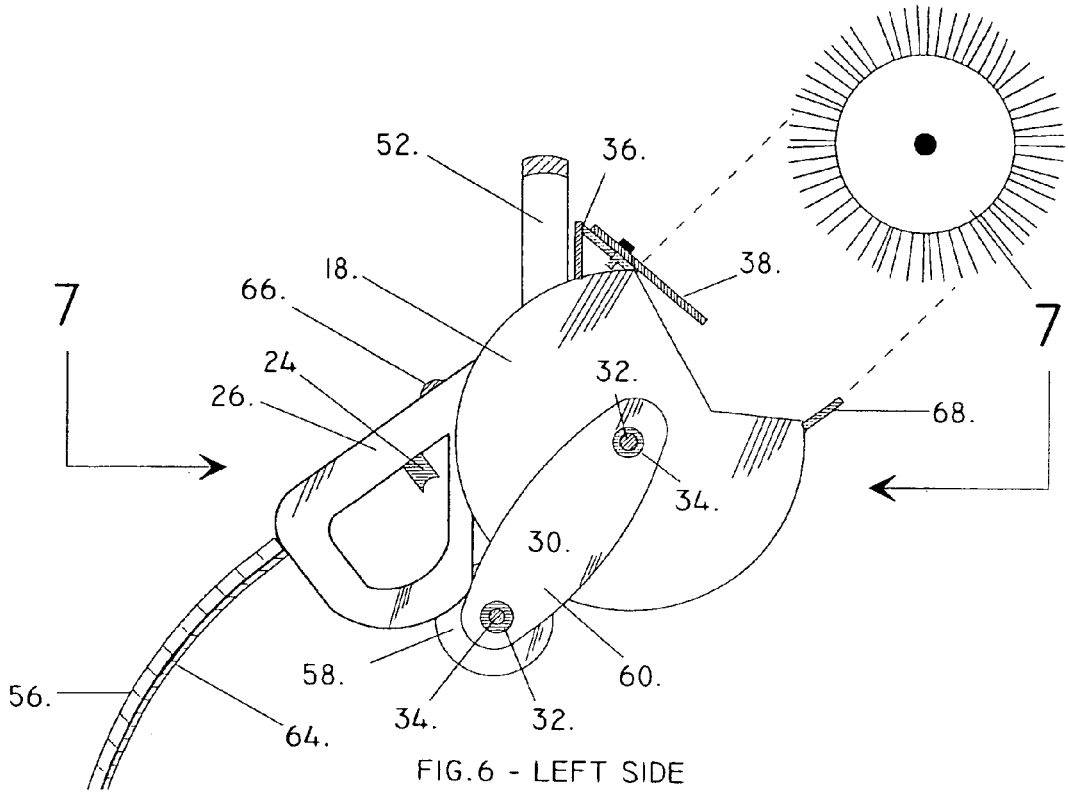
FIG.6 - LEFT SIDE
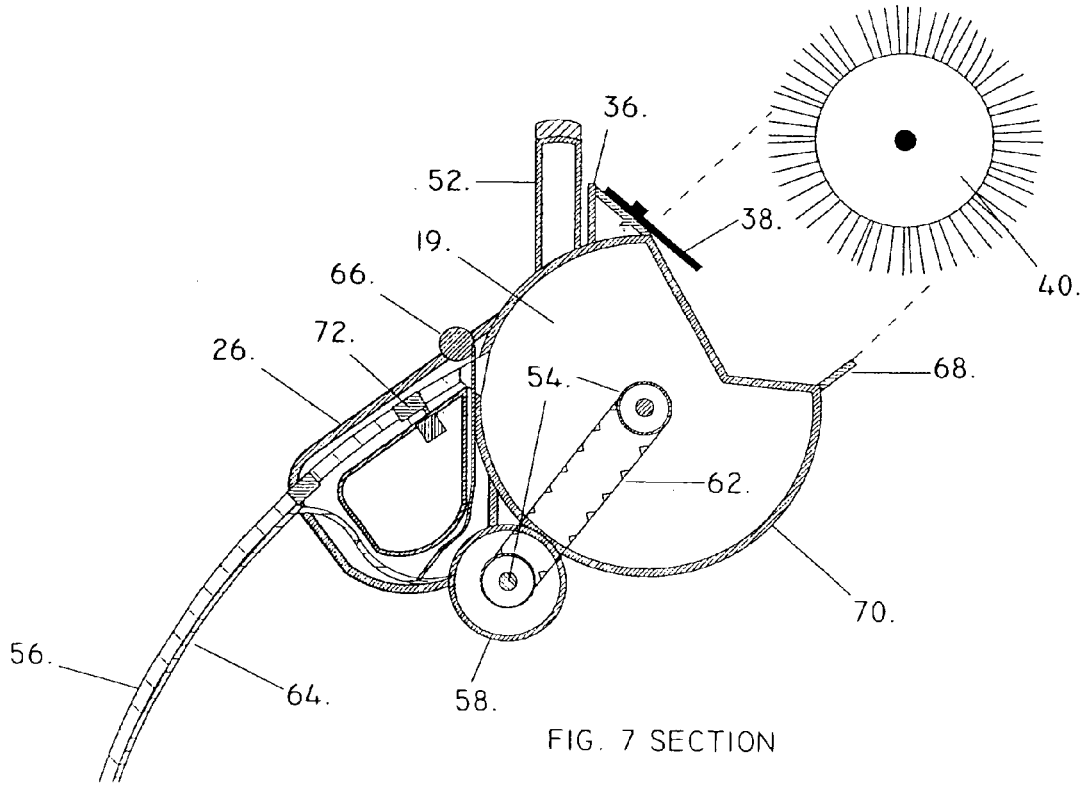
FIG. 7 SECTION

APPLICATOR FOR TEXTURING

CROSS-REFERENCE TO RELATED APPLICATIONS

This application claims priority to U.S. Provisional Application Ser. No. 60/558,738, filed Mar. 31, 2004, which is hereby incorporated by reference as if set forth herein.

BACKGROUND

1. Field of the Invention

The present invention relates to general drywall texture application and to the area of matching and repair of spray on drywall textures. More particularly, the present invention relates to a rotating applicator for texturing.

2. The Prior Art

The most common type of texture application utilized in commercial and residential construction today and over the last 30 years is the spray on type. Spray guns coupled with compressors have been the apparatus of choice. They produce an assortment of speckled patterns that are applied primarily to drywall surfaces. Although fairly economical and popular, the application method is messy and the patterns produced are limited and tired. There is a need for something new. Additionally, the repairing of damaged areas that utilize this type of texture application has also been a problem. Present solutions are inadequate, all having serious flaws and limitations. There are presently three commercial approaches that address these problems.

Air guns coupled with compressors are the main means of texture application today. Air guns and compressors are used for both new surfaces and in the repair of damaged areas. For both applications, there are serious drawbacks. Air guns and compressors are expensive and due to their complexity, they usually require the use of a contractor. The compressors are large, very often requiring a truck to move them around. Long hoses are needed to supply the guns with compressed air. They are impractical for small jobs or your typical homeowner re-modeler. The use of high-pressure air is also a major issue. This creates significant over-spray and dust disturbance. Neatness is a very important factor, especially in the area of remodeling. To minimize the potential mess, significant area preparation is required along with cleanup time. This added time equals added expense. The type of textures that can be produced by air guns are limited. Spray guns can generate droplets of different diameters and density only. A speckled type pattern is the only pattern possible.

Aerosol cans with texture compound inside are also available. Aerosol cans are expensive, contain little material, deliver poor results, and cannot be re-used. They are practical for small area repair only.

Bazooka type mechanisms, such as in U.S. Pat. No. 3,188,295, are also used, forcing air and material thru a nozzle with the force of your arm acting on a piston. This type of application does not allow for a steady stream of material, resulting in uneven, hard to control patterns. They are not practical to cover larger areas in either a uniform or timely manner.

U.S. Pat. No. 2,865,325 (Leston et al.) shows a device capable of flinging material, but with fatal defects in its applicability to accomplish the task desired, the ability to produce modern spray on type texture patterns. In its shown configuration the controls, portability, and other modifications required are just not present. This device was never intended nor capable of applying any decorative patterns in anything but a limited way. "The Leston device was only practical in applying much more dense coatings. The title itself "Applicator For Splattering of Masses" points directly to this fact. The use of spray on modern type textures was not in use at the time the application for this invention was filed in November 1954.

FIG. 1 in Leston shows a mass of material in a bottom-mounted reservoir 12. With this lower position, serious problems arise. Accurately controlling the amount of dispensed material is not possible. As the bristles or tines are passed thru the reservoir medium they pick up an amount of substance controlled only by the shape of the tines and amount of material present in the reservoir. Adjusting the bristles or tines would not significantly address this problem. As the material is ejected from the device, the reservoir level changes. This directly impacts the amount of material present on the tines or bristles, and ultimately the density of the pattern emitted.

It is imperative to be able to accurately control medium flow in order to control the devices output. This inability directly impacts droplet size, pattern density and over all versatility. The ease of directing the dispensed medium with the Leston device is also in question. As a hand held device, comfort, stamina, and portability is severely limited. The handle 18, as seen in FIG. 1, is located in an awkward, off centered, and unsupported position. Since the device is an unsealed unit, being open at the front and back, tipping the device significantly in either direction would cause the material to spill. The tripod mount system, as shown in FIG. 7, would be the most viable way of using the device. As a result, moving the device around would be quite cumbersome in anything but a vacant room.

FIG. 1 in Leston shows a splatter plate 33*a* in a fixed position. The splatter plate is referred to as a flick plate in the present invention. This plate is neither adjustable nor removable. There are major advantages in the ability to do so. Different plates produce different results.

FIG. 1 in Leston also shows a rotating brush assembly 26. This item is also in a fixed position. The inability to remove this brush and replace it with brushes of different density and pattern is a major limitation of Leston and the rest of the prior art.

The Leston device is incapable of producing or directing the type of spray-on texture patterns needed to match or duplicate what is needed in the market place of today. The fact that this invention is not now commercially produced points directly to its flaws.

SUMMARY

The present invention provides a new and superior way to reproduce existing spray on texture patters along with the application of new texture patterns as yet unseen. With the introduction of major modifications such as a top mounted hopper, medium flow control, modified casing, interchangeable brushes and flick plates of different configurations, exceptional and surprising results are obtained. It's ease of use, low cost, portability, and versatility make it a unique and needed addition to the present art.

In one preferred embodiment, the applicator comprises a top mounted hopper with a lid, a main body casing that attaches to the hopper, a primary handle that attaches to the hopper and casing, a trigger that is within the handle, an arm rest, a flow control tab attached to the trigger that controls the medium flow, an inlet slot at the bottom of the hopper that allows the medium to enter the brush chamber, a casing that contains the circular brush, a circular brush within the casing attached to a drive shaft, a removable cover on one side of the casing for brush removal and replacement, a flick plate with mounting bracket located at the bottom of the main casing cylinder wall, a series of gears attached to the drive shaft, a gear shaft that attaches to variable speed drill, and a variable speed screwdriver or crank handle for rotating the brush.

In another preferred embodiment, the hopper is replaced with a tank for containing the texture material and a supply line for delivering the texture material to the brush chamber.

It is an object of the present invention to provide an applicator with superior performance in its ability to match existing spray on type texture patterns as well as the ability to produce new custom patterns.

It is yet another object of the invention to provide an applicator that is hand held, easily directed, simple in operation, and low in cost;

It is yet another object of the invention to provide an applicator capable of many variations making it adaptable to any size job.

It is yet another object of the invention to provide an applicator that minimizes over spray, area preparation, and is not dependent on the use of high pressured air;

It is yet another object of the invention to provide an applicator that provides a consistent, steady, uninterrupted, uniform pattern of material.

It is yet another object of the invention to provide an applicator whose contents is contained in a sealed unit.

It is yet another object of the invention to provide an applicator with a easily accessed dedicated texture flow control.

It is yet another object of the invention to provide an applicator providing good balance, comfort and portability;

It is yet another object of the invention to provide an applicator capable of producing a variety of new texture patterns;

It is yet another object of the invention to provide an applicator that is capable of being powered by varied means including a standard variable speed drill.

It is yet another object of the invention to provide an applicator whose contents can be directed in a highly controlled and adjustable manner.

It is yet another object of the invention to provide an applicator with an array of circular brushes that are easily interchangeable.

It is yet another object of the invention to provide an applicator with flick plates that are interchangeable, and of various shapes.

Still further objects and advantages will become apparent from the consideration of the ensuing description and drawings.

DESCRIPTION OF THE DRAWINGS

FIG. 1 is a left side view of a first embodiment of a texturing applicator;

FIG. 2 is a right side view of the first embodiment;

FIG. 3 is a front view of the first embodiment;

FIG. 4 is a cross sectional view of the first embodiment at line 4;

FIG. 5 is a cross sectional view of the first embodiment at line 5;

FIG. 6 is a left side view of a second embodiment of a texturing applicator;

FIG. 7 is a cross sectional view of the second embodiment at line 7;

DETAILED DESCRIPTION

Figure 8:
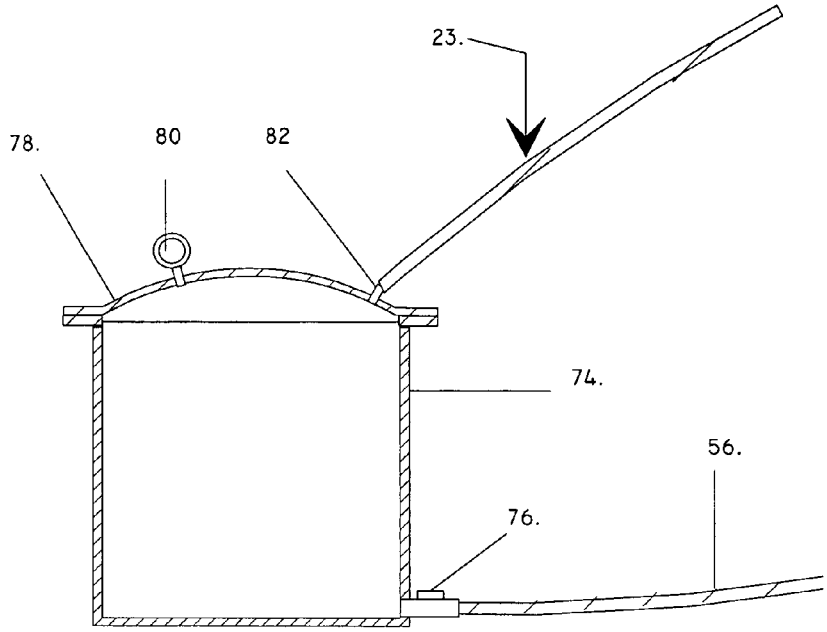
FIG. 8 is an illustration of an exemplary holding tank.

Persons of ordinary skill in the art will realize that the following disclosure is illustrative only and not in any way limiting. Other embodiments of the invention will readily suggest themselves to such skilled persons having the benefit of this disclosure.

FIGS. 1 through 5 show an exemplary embodiment of a texturing applicator according to the present invention. The basic operation of the applicator is as follows. A top mounted hopper 20 is filled to the desired level with texture medium. A hopper lid 22 seals the texturing material within the hopper 20. The device is held by a primary handle 26 and directed at the area to receive the texture coating. A crank handle 42 (shown in FIG. 1) or a conventional variable speed drill (not shown) may be used to rotate a circular brush 40 located within the main body casing 18. It is contemplated that other means may be employed to rotate the circular brush 40 as well. As the brush 40 turns, the bristles are forced against a flick plate 38. Once the desired rotation is reached, a flow control trigger 24 is depressed, allowing a metered amount of texture material to be dispensed to the brush chamber 19 within the casing 18 and upon the circular brush 40. As the brush 40 turns, the bristles are bent back upon the flick plate 38. When the bristles are released from the flick plate 38, droplets of material are flung upon the desired surface, creating a texture pattern.

While the main materials used for the preferred embodiment are rigid plastics, it is contemplated that a variety of other materials may be used as well. Any and all materials deemed of an equal or superior nature, for any parts, may be substituted. Parts requiring added durability and strength, such as bushings, bearings, gears, and shafts, shall be fashioned of materials suited to those requirements. Attachments may be made by, but are not limited to, the use of plastic or metal welds, uni-body construction and the use of screws, or similar devices. The preferred manufacturing method for major components, such as the hopper 20 and main body casing 18, is injection molding. However, it is contemplated that any other manufacturing techniques deemed preferable may be employed.

The hopper 20, which contains the hopper chamber 23 within, may be attached to the main body casing 18 to form one solid unit. The hopper 20 is located above and to the side of the casing 18 in a position that allows gravity to act upon the contents within hopper chamber 23, causing the contents to be directed towards the casing 18. The hopper 20 may have an irregular shape, such as being wider at the top than at the bottom. It may also have a rectangular straight sided top with a securely fitting rectangular lid 22 upon it.

The main body casing 18 is substantially cylindrical in shape. In a preferred embodiment, casing 18 is a one-sided cylinder, having an open side, such as the right side shown in FIG. 2. The interior circumference and width of the casing 18 are only slightly more than the circumference and width of the circular brush 40. The cylinder wall 70 is defined by the circumference and width of the casing 18. The brush 40 and casing area are a close tight fit, but do not bind with one another. Casing 18 may comprise an outlet notch or opening 67 existing through the cylinder wall 70. The opening 67 allows the texture material to exit the brush chamber 19 after the bristles or tines of the brush 40 are bent back and released from the flick plate 38. Although the opening 67 in FIGS. 1-5 comprises an angled notch, it is contemplated that a variety of shapes may be employed, including, but not limited to, other concave shapes and convex shapes (such as a continuation of the casing's cylindrical shape). Holes may be present in the casing's side to accept bushings 32, gear shaft 33 and driveshaft 50. A splatter lip 68 is shown at the top of notch 67, preventing the unwanted splatter of texture material on an undesired location.

An inlet slot 48 is present at the back of cylinder wall 70, allowing for the texture material to flow from the hopper 20 to the brush chamber 19. The slot 48 may extend substantially the width of cylinder wall 70.

A primary handle 26 is present. The handle 26 is attached to the hopper 20 and main casing 18. The handle 26 is hollow, allowing for internal components. An arm rest 28 may be attached to the hopper 20 or the handle 26. The arm rest 28 may be hollow in the middle and concave at the end to comfortably accept the operator's forearm.

An inlet control tab 49, shown in FIG. 4, is attached to the flow control trigger 24 located within primary handle 26. The tab 49 extends across the width and breadth of inlet slot 48. A trigger return spring 25 exists behind trigger 24.

A removable cover 44 may enclose the entire open side of the casing 18, such as the right side in FIG. 2. The outlet notch 67 may continue through the removable cover 44. The cover 44 may be attached by the use of wing nuts (not shown) or any like device to hard points located on the casing 18. A raised ring 47 may be located on the interior of the cover 44. The ring 47 fits snugly inside casing 18. Holes are present in cover 44 to accept bushing 32 and driveshaft 50.

The rotating brush 40 slides onto keyed driveshaft 50. As seen in FIG. 5, the driveshaft 50 passes through the left side of casing 18 and bushing 32, then continues through a gear cover 30 and bushing 32. A gear 34 is attached to driveshaft 50 in a fixed position. The gear 34 is meshed with a like gear 34 positioned directly under the first gear. This second gear is keyed to gear shaft 33. The gear shaft passes through holes in casing 18 and gear cover 30. Bushings 32 may be employed at either end. The shaft 33 extends out gear cover 30 side and allows the attachment of a hand crank 42 (shown in FIG. 1), a variable speed drill (not shown) and similar devices. The gear cover 30 is attached securely to casing 18.

A flick plate 38 and a flick plate bracket 36 are located on the exterior and towards the bottom portion of opening 67, on the opposite side of the casing 18 from the hopper 20 and inlet slot 48. The bracket 36 may be comprised of two pieces attached to one another and to casing 18, as seen in FIG. 4. The flick plate 38 is located atop the bracket and may be removably secured with wing nuts, set screws, or any other securing means known in the art.

The desired texture material, likely drywall texture compound, is deposited into the hopper chamber 23 within hopper 20. The hopper 20 is of an irregular shape and is located in a high position relative to the main casing 18. The location serves to provide maximum force of gravity upon the texture material inside the hopper 20 in order to facilitate delivery of the texture material to brush chamber 19. This position also allows the use of a texture flow control device at the hoppers bottom. The hopper lid 22 is set securely in place upon hopper 20, sealing the texture material within.

The applicator may be grasped by the primary handle 26 with the operator's left hand. The operator's forearm rests comfortably against the concave arm rest 28. The operator's right hand may then hold the hand crank 42, substituted variable speed drill or like device. The crank handle 42 is easily removed for this purpose, and a suitable end provided on the gear shaft 33 to accept the drill or like device. The use of a variable speed device as a power source provides a convenient, consistent and highly controllable way to power the device.

As viewed from the left side in FIGS. 1 and 4, a clockwise turning is imparted to gear shaft 33. When gear shaft 33 is turned, force is imparted to gear 34 located within gear cover 30. The cover 30 protects and holds the gears 34, their respective shafts 33 and 50, and bushings 32 in a locked stable position. The gear 34 located on gear shaft 33 turns a similar gear located directly above it. This second gear 34, also in a keyed fixed position, turns driveshaft 50. The driveshaft 50 is keyed holding the circular brush 40 in a fixed position. When viewed from the left side, the circular brush 40 turns in a counter clockwise direction. When the hand crank 42 turns gear shaft 33 in a clockwise direction, which is more comfortable for most people, the rotating brush 40 fixed upon shaft 50 is caused to turn in a counter clockwise direction. The turning of the circular brush 40 in this direction allows the texture droplets to be expelled in an upward direction. As the bristles or tines of the rotating brush 40 are bent back against the flick plate 38 and released, the texture material is flung in an upward trajectory upon the desired surface since the bristles or tines of the rotating brush 40 are being released from a lower position to a higher position. This upward movement helps counteract gravity, which tends to causes the texture droplets to sag. Upward movement mitigates this problem and also facilitates the coverage of ceiling areas. Lower areas can still be covered easily by tipping the applicator forward.

After reaching the desired rotation speed, the flow control trigger 24, located within the primary handle 26, is depressed by the operator. As the trigger 24 is pulled back, the inlet control tab 49 is in turn pulled back. The control tab 49, located under hopper 20, extends the breadth and width of the inlet slot 48, effectively sealing the hopper chamber 23 from the brush chamber 19 when in the closed position. The inlet slot 48 may extend the width of the cylinder wall 70. As the control tab 49 is pulled back, an even bead of texture material is deposited onto the surface width of the circular brush 40. The more the trigger 24 is depressed, the more material is allowed to enter. When the trigger 24 is released, a trigger return spring 25 located behind the trigger 24 returns the trigger 24 to the original closed position or to any spot in-between the open and closed position. Trigger 24 and control tab 49 provide the advantage of allowing the operator to conveniently and accurately control the amount of texture material being dispensed.

The circular brush 40 slides down upon the keyed drive shaft 50. As the circular brush 40 rotates and picks up material, it interacts with flick plate 38. As the bristles or tines are bent back upon the flick plate 38, tension is produced. When the bristles are released, the collected medium present on the bristles is flung out in the pointed direction, and deposited upon the desired surface. The flick plate 38 and flick plate bracket 36 are located at the bottom and exterior of casing 18. The bracket 36 is securely attached to cylinder wall 70. The bracket 36 provides an angled mounting platform for the flick plate 38. The flick plate 38 may have the substantially the same width as the width of the brush chamber 19 and extend into the brush chamber 19 to the desired depth. The flick plate 38 is adjustable, allowing for removal and replacement. The flick plate 38 may comprise a slot that allows the plate to slide in and out. The flick plates 38 may be secured by the use of wing nuts or like devices.

The circular brush 40 is accessed through the removable cover 44. The cover 44 may be removed by the removal of cover fasteners, which may be wing nuts or a variety of other securing means. Removing the cover 44 allows for easy access and replacement of the circular brush 40, with others of different configurations. The removable cover 44 also makes the cleaning of the applicator easier. The cover 44 may have a raised ring 47 located on the interior of the cover surface. The ring 47 fits snugly inside the cylinder wall 70 of casing 18. This centers the cover 44 and provides a good seal, solving any possible leakage problem.

Various modifications are possible with the embodiments so far described. Many components may be simplified, altered or even eliminated. Rigid plastics and aluminum are the primary envisioned materials. However, it is contemplated that a variety of other materials may be used as well. Any material deemed suitable may be employed. The hopper lid 22 may be altered or eliminated. The hopper 20 may be modified to any shape or size desired, so long as it promotes the flow of the texture material from the hopper chamber 23 to the brush chamber 19. The arm rest 28 may be eliminated. The double gears 34 and gear cover 30 can be eliminated for the simplicity of a direct drive.

Figure 10:
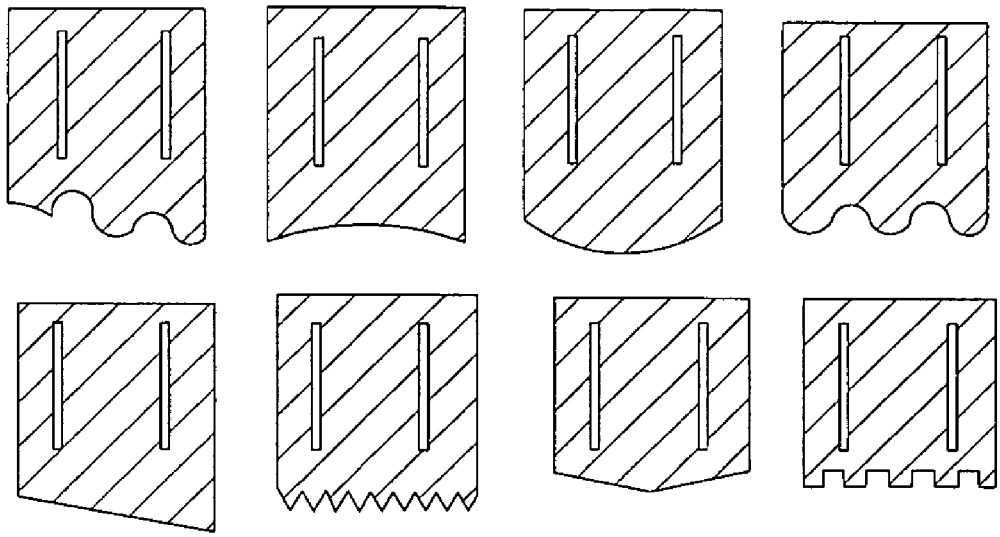
FIG. 10 is an illustration of exemplary flick plates.

Referring to FIG. 10, a variety of flick plates may be used interchangeably. Plates with different patterns are provided to assist in the application of custom patterns. The different plate shapes cause the bristles on the circular brush 40 to be pushed in various directions, causing different patterns to emerge.

Figure 9:
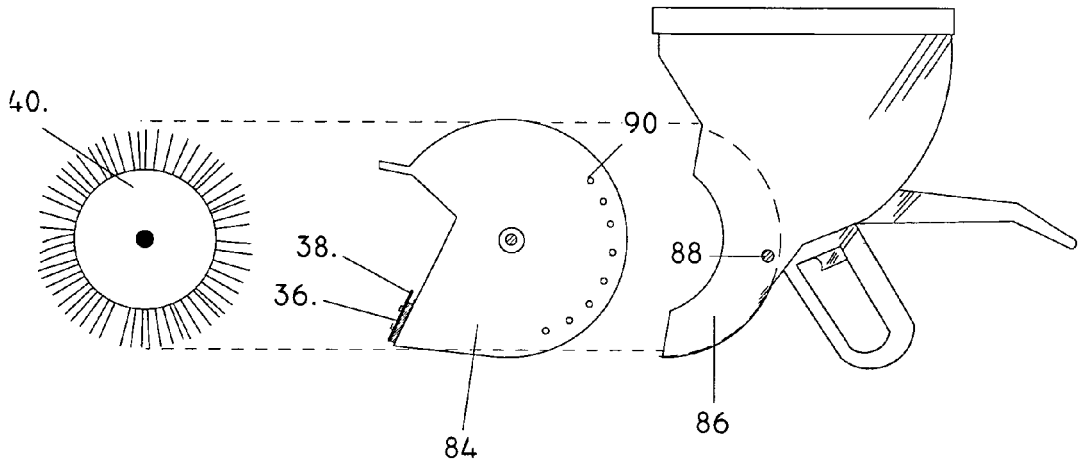
FIG. 9 is left side view of an exemplary brush cartridge and saddle.

Referring to FIG. 9, the main body casing and removable cover can be constructed separate from the hopper and primary handle. They would in essence form a circular cartridge 84. The cartridge assembly 84 would fix into a saddle 86 constructed as part of the hopper. The cartridge 84 would have the ability to rotate within the saddle 86. Rotating the cartridge 84 moves the flick plate to a higher or lower position, thereby changing the trajectory of the expelled texture material. This rotating configuration allows for easier coverage of ceiling areas. The cartridge 84 may be held in place by the use of a removable pin 88 located on saddle 86 and extending through one of a series of holes 90 on the side of cartridge 84, as seen in FIG. 9. As cartridge 84 is rotated, the pin 88 would line up with a different hole 90, thereby allowing for different secured positions. Although not shown, the cartridge 84 may also be held in place by the use of a removable pin 88 located on cartridge 84 and extending through one of a series of holes 90 on the side of saddle 86.

In FIGS. 6 and 7, a second embodiment of the applicator is presented. This applicator is designed to address the requirements of an applicator suited to larger jobs and to the application of custom texture patterns. For this purpose a number of modifications to the first embodiment have been made.

For efficiently covering large areas, an applicator utilizing a circular brush with a larger diameter and wider face is useful. With a wider face and larger diameter, large surface areas can be covered efficiently. The wider face and larger diameter also allow for more diverse bristle patterns, making the application of custom patterns more effective.

For comfort and stamina, the weight of the applicator may be reduced. The hopper on the first embodiment may be omitted. A remote location for the texture compound container may be used in its place. The container must be capable of holding a large amount of material, yet must also be portable.

Many of the features of the first embodiment are present in the second embodiment. The differences and additions are discussed below.

FIGS. 6 and 7 show a second embodiment of a texturing applicator according to the present invention. The power source utilized for this embodiment is a small motor 58. The motor 58 may be located and attached between the primary handle 26 and the main body casing 18. A standard belt pulley 54 may be affixed upon the motor's drive shaft. A second pulley 54 attaches to the main driveshaft 50, which in turn rotates the circular brush 40. A drive belt 62 is provided and exists in a taut position between both pulleys 54. A belt cover 60 may be affixed to main casing 18, protecting the belt 62 and pulleys 54 within.

The motor 58 may utilize a standard variable speed control mechanism 66 located in a secondary handle 52. The rotation speed can be easily set and manipulated by setting the speed control 66 to the desired speed. A power cord 64 may be located along side supply line 56. The secondary handle 52 is provided to add stability and support to the applicator, making it easier on the user to manipulate. The applicator is supplied with texture compound under pressure by a supply line 56. In order to control the flow through the supply line 56 to the brush chamber 19, an inline gate valve 72 is located in the primary handle 26. Depression of the flow control trigger 24 adjusts the flow rate through the line 56.

As seen in FIG. 8, the supply line 56, a pressure capable hose of suitable diameter, is connected to the bottom of supply tank 74. The tank 74 provides texture material to the brush chamber 19 through supply line 56. A gate valve 76 is provided at the tanks outlet point. The tank 74 may be made of aluminum and is preferably fitted with a pressure tight twist on lid 78. A pressure gauge 80 is present on the lid 78. An air inlet fitting 82 may also be present on the lid 78. A high pressure hose attached to a standard small compressor (not shown) may be hooked up to the inlet fitting 82, putting a constant even pressure on the tank's contents.

Other variations possible with this second embodiment include fitting the supply tank 74 with wheels and/or handles for portability. Although the flick plate 36 and flick plate bracket 38 in FIGS. 6 and 7 are mounted on the upper portion of the hopper casing 18, they can also be mounted in the lower position, such as in the first embodiment FIGS. 1-5.

Thus it should be apparent to the reader that some old technology surrounded by new innovations has resulted in an applicator of superior versatility and effectiveness in the application of existing texture patterns and new custom patterns. It should be apparent that an applicator has been provided that is simple in operation, easy to manufacture, light weight, and portable.

It should also be apparent that an applicator has been provided that can be built to different scales, that is capable of handling large or small jobs, that can produce a multitude of patterns, that utilizes re-moveable and varied flick plate and circular brush configurations, and that can utilize a hopper or supply tank.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention.

What is claimed is:

1. A hand-held applicator for texturing comprising:

a casing defined by two side walls and a cylinder wall coupled in between said two side walls, said cylinder wall defining the perimeter of said casing and comprising an opening on one side of said casing;

a material container coupled to a side of said casing substantially opposite said opening in a position that allows gravity to direct drywall material in said material container to the interior of said casing, said container including a flow gate configured to control the flow of said drywall material from said material container to the interior of said casing;

an adjustable flick plate coupled to said casing at the bottom of said opening and configured to create a pattern of said drywall material as said drywall material is projected from said casing, said adjustable flick plate being removable;

a brush assembly rotatably coupled to said casing and disposed in between said two side walls, said brush assembly configured to project said drywall material from said opening as said brush assembly is rotated;

a handle coupled to said casing and said material container, said handle positioned to allow an operator to lift and extend the applicator towards a surface to be textured;

a trigger that controls said flow gate coupled to said handle.

2. The applicator of claim 1, wherein the top of said material container extends above the top of said casing.

3. The applicator of claim 1, wherein one of said two side walls is a removable cover.

4. The applicator of claim 1, wherein said casing has a substantially cylindrical shape.

5. The applicator of claim 1, wherein said casing further comprises a splatter lip at the top of said opening.

6. The applicator of claim 1 further comprising an arm rest attached to either said material container or said handle, wherein said arm rest is hollow in the middle so as to accept a forearm.

7. The applicator of claim 1 further comprising a lid, said lid covering the top of said material container.

8. The applicator of claim 1, wherein said brush assembly comprises a circular brush operationally coupled to a drive shaft, said drive shaft is operationally coupled to a gear, said gear is operationally coupled to a gear shaft, wherein said gear shaft allows for the attachment of a hand crank for controlling the rotation of said circular brush.

9. The applicator of claim 1, wherein said brush assembly comprises a circular brush operationally coupled to a drive shaft, said drive shaft is operationally coupled to a gear, said gear is operationally coupled to a gear shaft, wherein said gear shaft allows for the attachment of a variable speed drill for controlling the rotation of said circular brush.

10. The applicator of claim 1, wherein said flow gate is a tab that covers an inlet slot located on said cylinder wall of said casing when said trigger is not pressed, said inlet slot providing direct access for the flow of said drywall material from the interior of said material container to the interior of said casing, said tab proportionately uncovers said inlet slot as said trigger is pressed.

11. The applicator of claim 1, wherein said casing may rotate vertically with respect to said material container, said casing being held in place by either a removable pin on said material container that extends through one of a series of holes on said casing or a removable pin on said casing that extends through one of a series of holes on said material container.

12. The applicator of claim 1, wherein the interior circumference and width of said casing is only slightly more than the circumference and width of said brush assembly allowing said brush assembly to pick up said drywall material from the interior of said casing.

* * * * *